United States Patent [19]

Fukuzuka et al.

[11] 4,202,751

[45] May 13, 1980

[54] SACRIFICIAL ANODE AND APPARATUS EMPLOYING SAME FOR TREATING HOT SEA WATER

[75] Inventors: Toshio Fukuzuka; Kazutoshi Shimogori, both of Kobe; Hiroshi Satoh, Suita; Fumio Kamikubo; Tatsuo Hara, both of Kobe, all of Japan

[73] Assignee: Kobe Steel, Ltd., Kobe, Japan

[21] Appl. No.: 905,940

[22] Filed: May 15, 1978

[30] Foreign Application Priority Data

Nov. 28, 1977 [JP] Japan ..... 52-143128

[51] Int. Cl.[2] ..... C23F 13/00

[52] U.S. Cl. ..... 204/197; 204/130; 204/148; 204/150

[58] Field of Search ..... 204/197, 196, 149, 152, 204/150, 279, 147, 148, 130; 75/123 K; 429/228

[56] References Cited

U.S. PATENT DOCUMENTS

| | | | |
|---|---|---|---|
| 383,150 | 5/1888 | Russell | 429/228 |
| 3,026,259 | 3/1962 | Phillips | 204/150 X |
| 3,102,086 | 8/1963 | Cotton | 204/148 X |
| 3,137,642 | 6/1964 | Johns | 204/148 |
| 3,186,931 | 6/1965 | Marsh et al. | 204/197 |
| 3,562,124 | 2/1971 | Leon et al. | 204/197 X |
| 3,836,407 | 9/1974 | Parker et al. | 75/123 K X |
| 3,837,844 | 9/1974 | Makita et al. | 75/123 K X |
| 3,892,604 | 7/1975 | Thornburg et al. | 75/123 K X |
| 3,919,068 | 11/1975 | Gary | 204/150 X |

*Primary Examiner*—Arthur C. Prescott
*Attorney, Agent, or Firm*—Oblon, Fisher, Spivak, McClelland & Maier

[57] ABSTRACT

A sacrificial anode for use in preventing corrosion of copper alloy parts and hydrogen absorption in titanium or titanium alloy parts of an apparatus useful for treating hot sea water, comprising a metal or metal alloy which maintains the potential of said copper alloy parts and titanium or titanium alloy parts serving as cathodes in said apparatus in the range of −0.5 to −0.65 V, relative to the potential of a saturated calomel electrode.

5 Claims, 11 Drawing Figures

FIG. 2
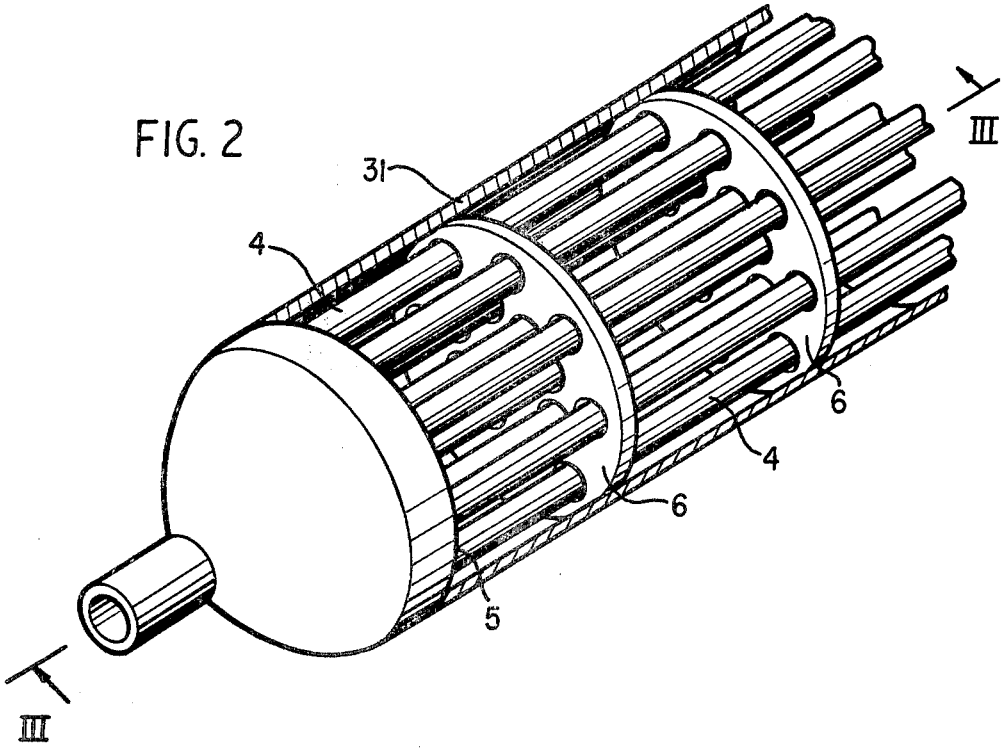
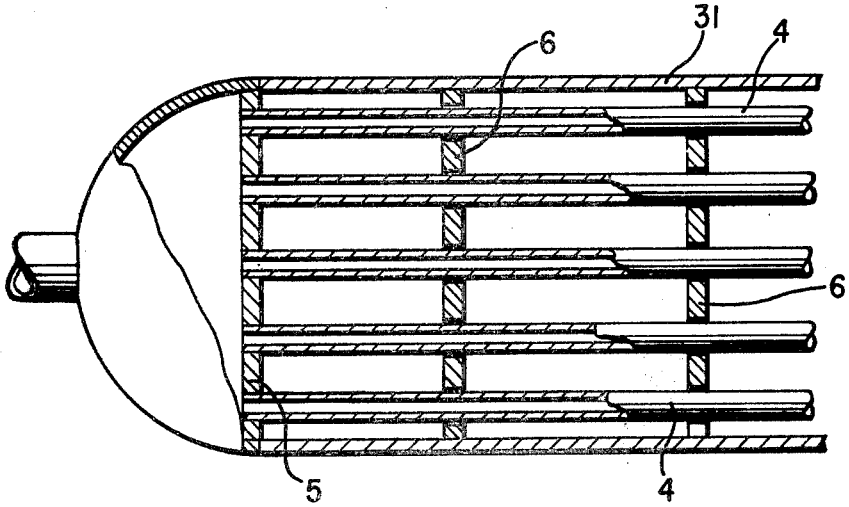
FIG. 3

SACRIFICIAL ANODE AND APPARATUS EMPLOYING SAME FOR TREATING HOT SEA WATER

BACKGROUND OF THE INVENTION

1. Field of the Invention

This invention relates to a sacrificial anode and an apparatus employing same for treating hot sea water, and more particularly to a sacrificial anode for use in preventing corrosion of copper alloy parts and hydrogen absorption in titanium or titanium alloy parts, which are built in the apparatus.

2. Description of the Prior Art

Typical of the sea-water desalting processes which have found a wide range of application is a multi-stage flashing process. FIG. 1 shows an outline of a multi-stage flashing process. Shown at 1 is a heat rejection section, at 2 a heat recovery section, and at 3 a sea-water heating section. Sea water A is delievered into heat transfer tubes 4 (see FIG. 2) in the heat rejection section 1 by means of a pump, and then used as a cooling medium for condensation of steam in a series of chambers, so that the sea water used as a coolant gradually or progressively absorbs the heat, as it travels through the apparatus. More particularly, sea water picks up latent heat from steam in the heat recovery section 2 and is further heated, and is then fed to the sea water heating section 3. The sea water is further heated by an external heat source, i.e., by steam present in the sea-water heating section 3, and then delivered past a series of chambers in the heat recovery section 2 and heat rejection section 1, whose pressures are decreased progressively, so that the sea water is subjected to flash-evaporation as it passes through these sections. The sea water thus condensed is discharged in the form of brine B by means of a pump and then introduced in pipe lines in the heat recovery section 2 again, for recirculation. Plain water which has evaporated from sea water in the heat recovery section 2 and heat rejection section 1 and which has clung to the outer surfaces of heat transfer tubes 4 is collected in a tray, and then withdrawn as plain water C by the suction of a pump. In this manner, because the multi-stage-flashing process utilizes heat exchange between heated water, and cooled condensate of evaporated or distilled water, good thermal efficiency is achieved thus rendering the process very desirable industrally. Because of the efficiency of the process increased amounts of sea water are treatable per unit time, thus finding wide application for the process in industry.

The sea-water-transportation tubes positioned in the upper portions of the heat rejection section, heat recovery section 2 and sea-water-heating section 3 are referred to as heat transfer tubes. For instance, as shown in FIG. 2 (a partial perspective view) and FIG. 3 (a partial cross-sectional view of FIG. 2, taken along the line III—III thereof), two or more heat transfer tubes 4 are arranged in parallel to improve heat exchange efficiency. In this respect, the opposite ends of each heat transfer tube 4 are secured to tube plates 5 having holes therein, while the intermediate portions thereof are supported by suitable buffle plates 6 having a plurality of holes therein, so that the oscillation of tubes because of the pulsating pressures of steam and sea water may be prevented. The heat transfer tubes 4 are enclosed within shell 31. Moreover, the inner surface of each heat transfer tube 4 contacts sea water, when sea water passes therethrough, while the outer surface of the heat transfer tube 4 is exposed to steam. For these reasons, superb corrosion resistance characteristics are essential for the heat transfer tubes 4. Accordingly, in general conventional apparatuses employ heat transfer tubes made of titanium, titanium alloys, copper alloys or the like, while the tube plates 5 are made of a titanium-lined steel, copper alloy or the like, and the buffle plates 6 are made of steel. However, apparatus of the type described above have recently been replaced by a combination of heat transfer tubes made of titanium or a titanium alloy, and tube plates 5 made of a copper alloy, because of the increased demands for increased service life and economy.

In general, the titanium alloys which have been available for this purpose include Ti-5Ta, Ti-6Al-4V, Ti-5Al-2Cr-1Fe, Ti-5Al-2.5Sn, Ti-15Mo-5Zr, Ti-0.3Mo-0.8Ni, Ti-15Mo-5Zr-3Al and the like. Suitable copper alloys have included naval brass, aluminum bronze, nickel-aluminum bronze, 9/1 cupronickel, 7/3 cupronickel and the like. At any rate, the use of these alloys, i.e., copper alloys and titanium or titanium alloys which will be simply referred to hereinafter as titanium, as the case may be, presents the problem that the copper alloys and titanium are electrically shortcircuited in hot deaerated sea water or sodium chloride solution, which results in the galvanic corrosion of these alloys. In this respect, however, the titanium heat-transfer tubes 4 are not significantly subject to galvanic corrosion, although various problems are likely to occur because of corrosion to the copper alloy tube plates 5, with the result that the portions of the tube plates 5 which hold the heat transfer tubes 4 come off, or otherwise sea water leakes therethrough, thus failing to provide the intended, long service life for apparatus which treat hot, deaerated sea water. Furthermore, still another problem is the potential danger of hydrogen brittleness of the titanium tubes which results from the absorption of hydrogen by the tubes which stems from the corrosion in the copper alloy parts of the apparatus thus presenting still another cause for premature trouble or loss of intended service life of the titanium tubes.

SUMMARY OF THE INVENTION

It is a principal object of the present invention to provide a sacrificial anode and an apparatus employing the same, for preventing corrosion in copper alloy parts and hydrogen absorption in titanium or titanium alloy parts, which are components of a hot-sea-water-treating apparatus, such as a multi-stage-glashing type, sea-water-desalting apparatus.

According to the first aspect of the present invention, there is provided a sacrificial anode which maintains the potential at the copper alloy parts and titanium or titanium alloy parts which simultaneously serve as cathodes and components for an apparatus for treating hot sea water within a range of −0.5 to −0.65 V with reference to the potential of the saturated calomel electrode.

According to the second aspect of the present invention, there is provided a sacrificial anode, as defined in the first aspect of the invention, which consists essentially of more than 1% by weight, preferably from 2 to 95% by weight of Ni, and the balance being Fe.

According to the third aspect of the present invention, there is provided a sacrificial anode, as defined in the first aspect of the present invention, which consists essentially of from 2 to 95% by weight of Ni, less than 30% by weight, preferably not more than 20% by weight of at least one element selected from the group of Mo, Si, Mn and Al and/or less than 10% by weight, preferably not more than 2% by weight of at least one element selected from the group of Cu Sn, Ti, V and Nb, with the balance being Fe.

According to the fourth aspect of the present invention, the present sacrificial anode consists essentially of less than 7% by weight, preferably not more than 5% by weight of Cr, with the balance being Fe.

According to the fifth aspect of the present invention, there is provided a sacrificial anode as defined in the first aspect of the invention, which consists essentially of less than 5 to 7% by weight of Cr, and less than 30% by weight of Ni, or less than 5% by weight of Cr and not more than 30% by weight of Ni, with the balance being Fe.

According to the sixth aspect of the present invention, there is provided a sacrificial anode as defined in the first aspect of the invention, which consists essentially of less than 7% by weight of Cr, less than 30% by weight of Ni and/or less than 25% by weight, preferably, not more than 20% by weight of at least one element selected among Mo. Si, Mn, and Al, and/or not more than 10% by weight of at least one element selected from the group of Cu, Sn, Ti, V and Nb, with the balance being Fe.

According to the seventh aspect of the present invention, there is provided a sacrificial anode as defined in the first aspect of the invention, which consists essentially of pure copper alone or less than 15% by weight, preferably not more than 10% by weight of Sn and/or Zn, with the balance being Cu.

According to the eighth aspect of the present invention, there is provided a sacrificial anode as defined in the first aspect of the invention, which consists essentially of less than 20% by weight, preferably not more than 10% by weight of Sn and/or less than 30% by weight, preferably not more than 20% by weight of Al, with the balance being Pb, such that the total content of Sn and/or Al is less than 50% by weight, preferably not more than 25% by weight.

According to the ninth aspect of the present invention, there is provided a sacrificial anode as defined in the first aspect of the invention, which consists essentially of from 3 to 70% by weight of Mn with the balance being Fe.

According to the tenth aspect of the present invention, there is provided a sacrificial anode as defined in the first aspect of the invention, which consists essentially of from 3 to 90% by weight of Co with the balance being Fe.

According to the eleventh aspect of the present invention, there is provided a sacrificial anode as defined in the first aspect of the invention, which consists essentially of 3 to 90% by weight of Co, not more than 20% by weight of at least one element selected from the group of Ni, Mo, Si, Mn and Al, and/or not more than 10% by weight of at least one element selected from the group of Cu, Sn, Ti, V and Nb, with the balance being Fe.

According to the twelfth aspect of the present invention, there is provided an apparatus for treating hot water, which incorporates copper alloy parts and titanium or titanium alloy parts therein, wherein a sacrificial anode is provided inside the apparatus in a position in which it contacts sea water in a manner which establishes an electrical shortcircuit with copper alloy parts and titanium or titanium alloy parts, and which maintains the potential of the above parts within a range of −0.5 to −0.65 V, with reference to the potential of a saturated calomel electrode.

According to the thirteenth aspect of the present invention, there is provided an apparatus for treating hot sea water, in which is incorporated titanium or titanium alloy parts, wherein certain members which establish an electrical shortcircuit with the titanium or titanium alloy parts consist of a Fe-Ni base alloy containing not less than 1% by weight, preferably not less than 2% by weight of Ni, or a Fe-Cr base alloy containing not less than 0.5%, preferably not less than 1% by weight of Cr.

BRIEF DESCRIPTION OF THE DRAWINGS

FIG. 2 is a perspective view of an essential part of a combination of heat transfer tubes constituting sea-water-transporting tubes;

FIG. 3 is a cross-sectional view taken along the line III—III of FIG. 2;

FIG. 11 is a perspective view of a sample piece.

DESCRIPTION OF THE PREFERRED EMBODIMENT

Figure 1:
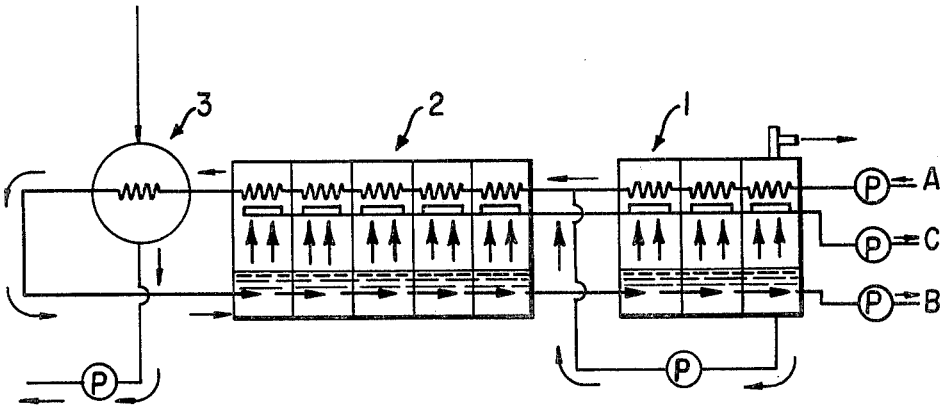
FIG. 1 is a schematic view of a multi-stage-flashing sea-water desalting process.
Figure 4:
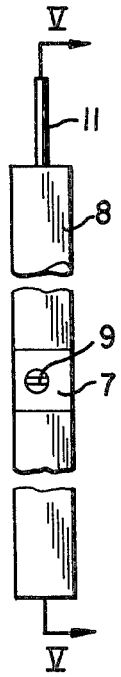
FIG. 4 is a front view of a test sample.
Figure 5:
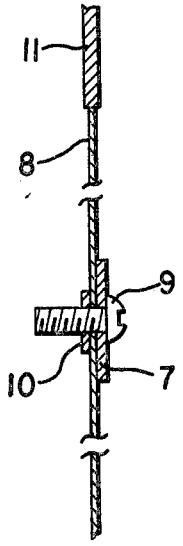
FIG. 5 is a cross-sectional view taken along the line V—V of FIG. 4.
Figure 6:
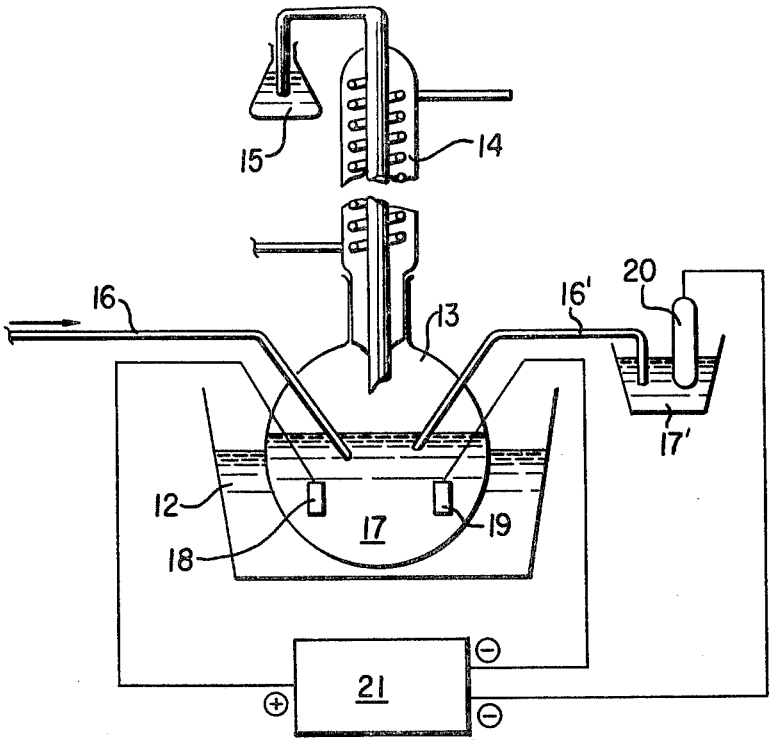
FIG. 6 is a view illustrative of an arrangement of test equipment.
Figure 7:
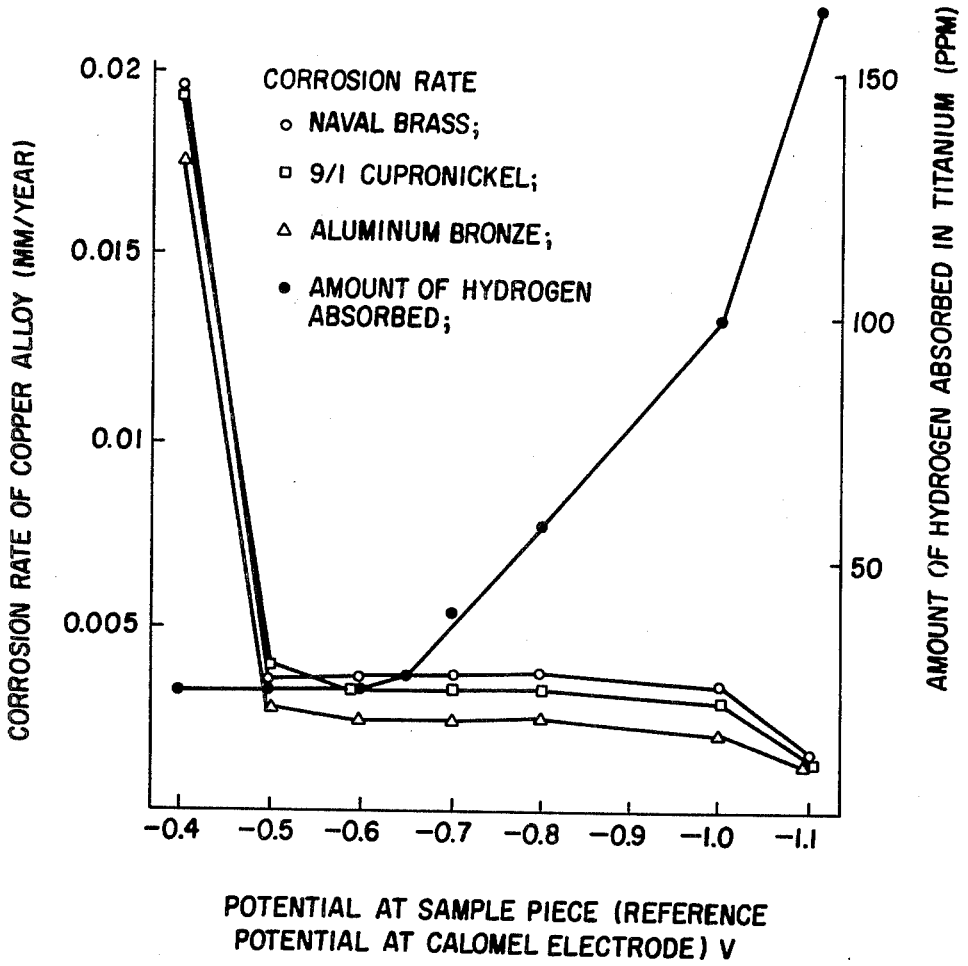
FIG. 7 is a graphical presentation representing the results of tests.
Figure 8:
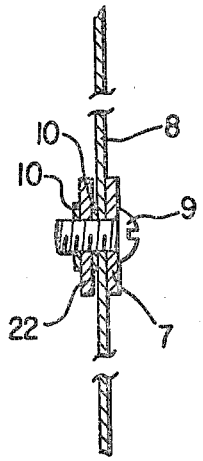
FIG. 8 is a graphical presentation representing the influence of temperatures on hydrogen brittleness in titanium and corrosion in copper.

It has been a widely accepted concept that galvanic corrosion in copper alloys soaked in hot sea water is attributable to the contact thereof with titanium which has a different potential, than the copper alloys being used as anodes, and hence the copper or copper alloy elements are dissolved. Accordingly, in principle it is believed that corrosion may be prevented intentionally using cathodes of a copper alloy. The inventors confirmed this phenomenon from tests involving test samples prepared as shown in FIG. 4 with a cross-sectional view as shown in FIG. 5, taken along the line V—V in FIG. 4, in the text apparatus shown in FIG. 6. More specifically, as shown in FIGS. 4 and 5 a copper alloy sheet 7 of a square contour was prepared, having dimensions of 1 mm×10 mm×10 mm, while a pure titanium sheet 8 of a rectangular contour was prepared, having dimensions of 0.5 mm×10 mm×100 mm. In addition, holes are provided in the centers of the both sheets 7 and 8, which are fastened together by means of a titanium bolt 9 and a nut 10, through the holes in the sheet. Shown at 11 is a pure titanium lead wire of a diameter of 1 mm. FIG. 6 is a view illustrative of the test equipment. A flash 13 having a volume of one liter is dipped into a constant-temperature oil bath 12. The flash 13 contains a 6% sodium chloride solution 17. The 6% sodium chloride solution is deaerated with pure argon gas introduced through pipe 16 in the direction of the arrow. The argon gas thus introduced passes through a tube positioned in a cooling means 14 into plain water 15 and then is discharged to the atmosphere. The pH of the sodium chloride solution 17 is 6. Immersed in the sodium chloride solution bath 17 are a platinum-plated titanium anode 18 and a sample piece (copper alloy) 19 serving as a cathode, while one end of glass tube 16' once filled with agar-containing potassium chloride, is immersed in solution 17 while the other end is immersed in potassium chloride solution 17' and therefore is in communication with saturated calomel electrode 20, which in turn is connected to a constant-potential electrolyzer 21. The temperature of the sodium chloride solution is maintained at 100° C., while the potential at the sample piece is within the range of −0.4 to −1.1 V. These conditions were maintained for a period of one month. Thereafter, sample piece 19 was removed from the apparatus for measurements to determine reductions in weight of the copper alloy, as well as the amount of hydrogen absorbed in titanium 8. FIG. 7 shows the results of the measurements. (30 ppm of hydrogen were already present in titanium 8.)

As is best shown in FIG. 7, a potential of −0.4 V results in an sharp increase in corrosion rate, irrespective of the type of copper alloy, while a potential of not more than −0.5 V results in a sharp decrease in the conrosion rate. However, the lower the cathode potential (the higher the absolute value), the more the amount of hydrogen absorbed in the titanium. In this respect, the amount of hydrogen absorbed exhibited a linear-functional increase in the range of less than −0.65 V. In summary, the optimum range of potentials at the copper alloy and titanium were found from −0.5 to −0.65 V, with reference to the potential at a calomel electrode, for the purposes of preventing corrosion in copper alloys and hydrogen brittleness in titanium.

The measure taken by the inventors to maintain the potential in the range of −0.5 to −0.65 V for copper alloy parts and titanium or titanium alloy parts which are built in the hot-sea-water-treating apparatus was the placement of a sacrificial anode in a position to contact sea water inside the apparatus so that it shortcircuited to the above mentioned parts. For this reason, a sacrifical anode was adopted which provides a natural potential of −0.5 to −0.65 V with respect to the potential at the calomel electrode. The following test was performed on various types of metals and alloys.

The corrosion found in copper alloy parts and hydrogen absorption in titanium or titanium alloy parts which are used in apparatus for use in treating hot sea water such as a multi-stage-flashing sea-water-desalting apparatus, were studied and the solution to the problem was found in a sacrificial anode which maintains the potential of the aforenoted parts serving as cathodes in a range of −0.5 to −0.65 V with respect to the potential at a saturated calomel electrode.

The following tests were applied to various types of metals and alloys to discover a sacrificial anode which possesses a natural potential in a range of −0.5 to −0.65 V with respect to the potential of the calomel electrode in hot sea water. More specifically, a deaerated sodium chloride solution (6%, pH=6) maintained at 100° C. in a test apparatus as shown in FIG. 6 was first prepared, and then various types of metals and alloys were immersed therein, and a calomel electrode 20 was also immersed therein, while each of the above metals or alloys was connected to the calomel electrode via a potentiometer to measure the potential difference therebetween. Table 1 shows the results of the tests. The potentials of Zn, Fe and Al which were tested as sacrificial electrodes were found to be −1.1 V, −0.8 V, and −0.95 V, respectively. Prior to the test, it was anticipated that the corrosion rate of copper alloys would be low, while the amount of hydrogen absorbed in titanium would be significant. The test results confirmed what was believed to be true about these materials. (See the results in Table 1). In contrast thereto, the potentials at the following metals and alloys were found to fall within the range of −0.5 to −0.65 V, so that the effectiveness of these metals and alloys as sacrificial electrodes was proven.

(1) Fe-Ni base alloy containing over 1% Ni.

At least more than 1% nickel should be present in the alloy with no upper limit for the nickel content. However, the potential of pure nickel is likely to approach zero which will facilitate corrosion to applied copper. Moreover, nickel is costly, so that the upper limit for the nickel content should be 95% by weight. Suitable alloy elements which may be present other than nickel include Mo, Si, Mn, Al, Cu, Sn, Ti, V, Nb and the like. However, the total content of the first four alloy elements should be less than 30% by weight, while the total content of the other elements should be less than 10%. Further preferred ranges of these alloy elements are as follows:

Ni: 2 to 95%;

Mo, Si, Mn, Al: not more than 20% (total content;)

Cu, Sn, Ti, V, Nb and the like: not more than 2% (total content)

(2) Fe-Cr base alloy containing less than 7% by weight of chrominum:

Less than 7% by weight of chrominum should be present in the alloy. However, this type of alloy may contain other well known alloy elements such as Ni, Mo Si, Mn, Al, Cu, Sn, Ti, V, Nb and the like. The preferred contents of these alloy elements are as follows:

Cr: less than 7% by weight (preferably not more than 5%;)

Ni: not more than 30% (preferably less than than 30% when the content of chrominum is not more than 5%.);

Mo, Si, Mn Al: less than 25% (total content, preferably not more than 20%);

Cu, Sn, Ti, V, Nb and the like: not more than 10% by weight (total content)

(3) Copper based alloys containing less than 15% by weight total content of Sn and/or Zn or pure copper:

The preferred total content of Sn and Zn is not more than 10% by weight.

(4) Lead based alloys containing less than 20% by weight of Sn and/or less than 30% by weight of Al:

The preferred content of Sn is not more than 10% by weight, while that of Al is not more than 20% by weight. When these two elements are used in combination, the total content of these elements should be not more than 25% by weight.

(5) Fe-Mn based alloys containing from 3 to 70% by weight of Mn.

When the sacrificial anode consists of an alloy of Mn and Fe, the amount of Mn present should be in the range of 3 to 70% by weight.

(6) Fe-Co based alloys containing from 3 to 90% by weight of Co:

From 3 to 90% by weight of cobalt should be present therein. However, this type of alloy may contain alloy elements such as Mo, Si, Ni, Mn, Al, Cu, Sn, Ti, V, Nb and the like. The preferred contents of these alloy elements are as follows:

Co: from 3 to 90% by weight;

Ni, Mo, Si, Mn, Al: not more than 20% by weight (total amount);

Cu, Sn, Ti, V, Nb: not more than 10% by weight (total amount);

As has been discussed above, it has been found that certain metals and alloys present potentials in the range of −0.5 V to −0.65 V. In addition, these elements were found to meet the following requirements arising from a need to build these elements in the apparatus, as sacrificial anodes:

These requirements are such that:

(1) The potential of the anode must be stable or consistent;

(2) The element must be uniformly soluble in sea water;

(3) The electric current allowed per unit surface area must be great (i.e., less polarization); and (4) The mechanical strength must be high.

Figure 9:
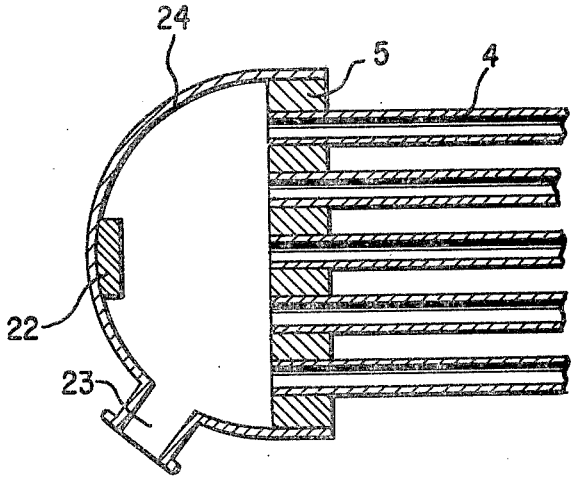
FIG. 9 is a cross-sectional view of a test sample for use in confirming the effect of a sacrificial anode.

To this end, metals and alloys have been selected which meet the above requirements. However, the metals were subjected to still another test to confirm that these metals could prevent corrosion of copper alloys and prevent hydrogen absorption in titanium or titanium alloys. More specifically, copper alloy sheets 7, pure titanium sheets 8, bolts 9 and nuts 10 of the same dimensions as those shown in FIGS. 4 and 5 were prepared. In addition, flat sheets 22 (1 mm×10 mm×10 mm) of the metals and alloys shown in Table 1 were also prepared as sacrificial anodes. Flat sheets 22 were provided with holes of 6 mm in their centers. Then, the parts were assembled together as sample pieces as shown in FIG. 9. The sample pieces were immersed for one month in a 6% soldium chloride solution (pH . . . 6) which had been maintained at 100° C. and deaerated in the apparatus shown in FIG. 6. Thereafter, the sample piece was removed for measurement of the loss in weight of the copper alloy because of corrosion and the amount of hydrogen absorbed in the titanium. The results shown in Table 1 were obtained which verify what had been believed about these materials copper alloys such as naval brass, aluminum bronze, nickel aluminum bronze, 9/1 cupronickel, and 7/3 cupronickel, were subjected to a test. The test results exhibit the same tendency for the tested copper alloys. Table 1 shows the results of tests on only naval brass.

Table 1

| Type of sacrificial anode | Potential relative to potential at calomel electrode (V) | Decrease in weight of copper alloy (mg/sample/month) | Amount of hydrogen absorbed in titanium (ppm) | Accepted or Rejected |
|---|---|---|---|---|
| Zn | −1.1 | 0 | 160 | X |
| Al | −0.95 | 0 | 100 | X |
| Fe | −0.8 | 0 | 60 | X |
| Fe — 1%Ni | −0.7 | 0 | 50 | X |
| Fe — 2%Ni | −0.65 | 0 | 0 | O |
| Fe — 3%Ni | −0.60 | 0 | 0 | O |
| Fe — 30%Ni | −0.57 | 0 | 0 | O |
| Fe — 95%Ni | −0.52 | 0 | 0 | O |
| Ni | −0.45 | 5.8 | 0 | X |
| Fe — 25%Ni — 10%Al | −0.62 | 0 | 0 | O |
| Fe — 20%Ni —10% —Si —10%Al | −0.60 | 0 | 0 | O |
| Fe — 20%Ni — 10%Mn — 5%Mo | −0.63 | 0 | 0 | O |
| Fe — 30%Ni — 20%Si — 10%Al | −0.43 | 5.0 | 0 | X |
| Fe — 30%Ni — 2%Cr | −0.53 | 0 | 0 | O |
| Fe — 30%Cr — 5%Cr | −0.47 | 5.2 | 0 | X |
| Fe — 5%Or | −0.62 | 0 | 0 | O |
| Fe — 7%Cr | −0.45 | 5.1 | 0 | X |
| Fe — 3%Cr — 2%Ni | −0.60 | 0 | 0 | O |
| Fe — 3%Cr — 10%Si — 5%Mo | −0.57 | 0 | 0 | O |
| Fe — 3%Cr — 10%Si — 10%Al — 5%Mo | −0.43 | 5.5 | 0 | X |
| Cu — 10%Sn | −0.55 | 0 | 0 | O |
| Cu — 10%Zn | −0.63 | 0 | 0 | O |
| Cu — 15%Sn | −0.70 | 0 | 60 | X |
| Cu — 20%Zn | −0.80 | 0 | 70 | X |
| Cu | −0.60 | 0 | 0 | O |
| Pb | −0.45 | 4.8 | 0 | X |
| Pb — 10%Sn | −0.55 | 0 | 0 | O |
| Pb — 20%Al | −0.60 | 0 | 0 | O |
| Pb — 20%Sn | −0.80 | 0 | 60 | X |
| Pb — 30%Al | −0.78 | 0 | 70 | X |
| Sn | −0.82 | 0 | 100 | X |
| Fe — 2Mn | −0.7 | 0 | 58 | X |
| Fe — 4Mn | −0.65 | 0 | 0 | O |
| Fe — 10Mn | −0.64 | 0 | 0 | O |
| Fe — 20Mn | −0.60 | 0 | 0 | O |
| Fe — 30Mn | −0.62 | 0 | 0 | O |
| Fe — 35Mn | −0.68 | 0 | 10 | X |
| Fe — 70Mn | −0.72 | 0 | 168 | X |
| Mn | −1.2 | 0 | 172 | X |
| Fe — 2Co | −0.7 | 0 | 54 | X |
| Fe — 4Co | −0.64 | 0 | 0 | O |
| Fe — 10Co | −0.61 | 0 | 0 | O |
| Fe — 20Co | −0.58 | 0 | 0 | O |
| Fe — 50Co | −0.55 | 0 | 0 | O |
| Fe — 70Co | −0.54 | 0 | 0 | O |
| Fe — 90Co | −0.52 | 0 | 0 | O |

Table 1-continued

| Type of sacrificial anode | Potential relative to potential at calomel electrode (V) | Decrease in weight of copper alloy (mg/sample/month) | Amount of hydrogen absorbed in titanium (ppm) | Accepted or Rejected |
|---|---|---|---|---|
| Fe — 95Co | −0.49 | 4.0 | 0 | X |
| Co | −0.45 | 4.8 | 0 | X |
| Fe — 10%$N_i$ — 5%Mn — 2%Co | −0.58 | 0 | 0 | O |
| Fe — 3%Cr — 10%Mn | −0.61 | 0 | 0 | O |
| Fe — 5%Cr — 20%Mn | −0.63 | 0 | 0 | O |
| Fe — 3%Cr — 10%Ni — 5%Co | −0.59 | 0 | 0 | O |
| Fe — 2%Cr — 8%Ni — 5%Mn — 3%Co | −0.60 | 0 | 0 | O |
| Fe — 4%Cr — 15%Mn — 10%Co | −0.58 | 0 | 0 | O |
| Fe — 10%Co — 10%Ni | −0.60 | 0 | 0 | O |
| Fe — 5%Co — 10%Ni | −0.62 | 0 | 0 | O |
| Fe — 15%Co — 5%Ni | −0.53 | 0 | 0 | O |
| Fe — 30%Co — 2%Cr | −0.52 | 0 | 0 | O |
| Fe — 20%Co — 5%Cr | −0.55 | 0 | 0 | O |
| Fe — 10%Co — 5%Cr | −0.57 | 0 | 0 | O |
| Fe — 40%Co — 10%Mn | −0.52 | 0 | 0 | O |
| Fe — 20%Co — 20%Mn | −0.55 | 0 | 0 | O |
| Fe — 10%Co — 10%Mn | −0.57 | 0 | 0 | O |
| Fe — 10%Co — 5%Mn | −0.57 | 0 | 0 | O |

As best shown in Table 1, when the cathode potential falls within the range of −0.5 to −0.65 V, the corrosion exhibited by the copper alloy and the hydrogen absorbed by titanium may both been inhibited. When the cathode potential is closer to zero, in comparison to the above range a marked increase in weight of the copper alloy is observed because of corrosion while a cathode potential less than the above range results in a sharp increase in the amount of hydrogen absorbed in titanium.

Figure 10:
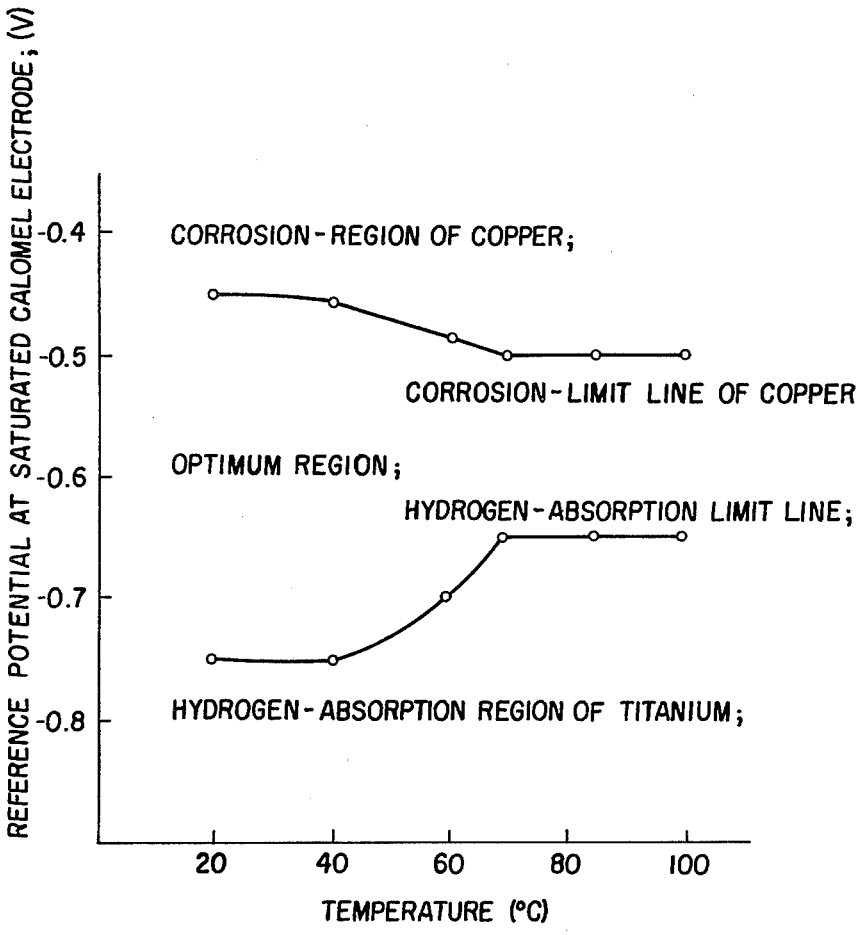

In this manner, specific types of sacrificial anodes have been discovered which are well adapted for use in the present invention. Moreover, in an apparatus for use in practical applications, such as for instance, a multi-stage-sea-water-desalting apparatus, the sacrificial anode 22 may be secured in position by means such as bolts and nuts in a water box 24, as shown in FIG. 10. Shown at 23 is an entrance and exit for sea water. In addition, the inner surface of the water box 24 which is made of steel, in general, is lined with a copper alloy or an organic material (rubber or the like). However the size, number and positions to which the sacrificial anodes 22 are attached, should not be construed in a limitative sense in the present invention.

In the above described tests, a sodium-chloride solution heated to 100° C. was used. On the other hand, tests were repeatedly conducted in the test apparatus shown in FIG. 6, with the temperature of the sodium-chloride solution being varied, for the measurement of the hydrogen-absorption limit potential and copper-corrosion limit potential. As a result, it was found that even when the cathode potential is less than that specified in the present invention, i.e., even at a temperatures less than 70° C., no absorption of hydrogen in titanium occurs nor does any corrosion occur in copper alloys, and that the most important portions which dictate the improvement are those portions which contact sea water or steam at temperatures higher than 70° C. (FIG. 10).

A further study was conducted on the corrosion and hydrogen absorption characteristics in parts which are exposed to hot steam in a hot-sea-water treating apparatus. The following discoveries were made.

When any one of the steam-exposed-side members of a tube plate 5 adapted to support the opposite ends of each heat transfer tube 4, a buffle plate 6 and a shell 31 is made of steel, the portion in contact and between the titanium transfer tube 4 and the steel part produces a galvanic couple of titanium to iron according to the electro-chemical reaction as follows:

$$\text{Anode } Fe \rightarrow Fe^{2+} + 2e$$

$$\text{Cathode } 2H^{+} + 2e \rightarrow 2H$$

Titanium is very reactive with hydrogen, so that atomic hydrogen, which has been produced at cathodes, will immediately react with titanium, thus resulting in hydrogen brittleness of titanium tubes 4 and premature loss of the desired service life thereof.

To cope with adversity other metals or alloys as a substitute for steel and which are suitable for the steam-exposed-side members of the buffle plates 5, supporting plates 6 and shell 31 were studied.

Figure 11:
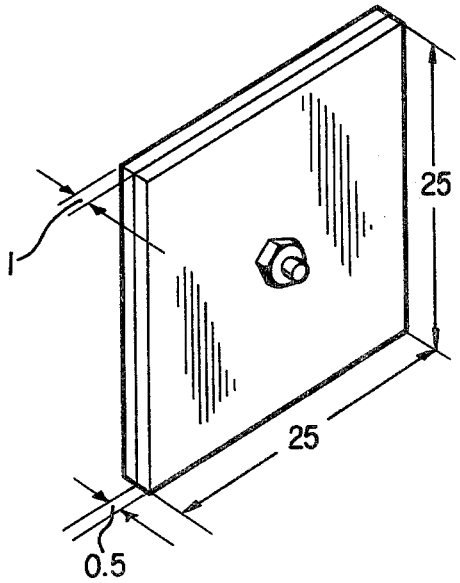
FIGS. 10 and 11 are cross-sectional views of the multi-stage-sea-water-desalting apparatuses, to which the respective processes according to the present invention are applied.

To this end sample pieces made of various types of metals and alloys in the shapes and dimensions shown in FIG. 11 were prepared and then exposed to steam at 150° C. for one month. Thereafter the samples well measured for the amount of hydrogen absorbed in titanium.

Table 2 shows sample pieces, i.e., (1) a titanium sheet alone; (2) a composite sheet of a titanium sheet and a steel sheet; and (3) a composite sheet of Fe-Ni and Fe-Cr base alloys, and a titanium sheet.

Table 2

| Test No. | Sample piece material | amount of hydrogen absorbed in titanium (ppm) prior to test | after test |
|---|---|---|---|
| 1 | Ti | 21 | 21 |
| 2 | Ti + steel | 21 | 105 |
| 3 | Ti + 0.5% Ni steel | 21 | 103 |
| 4 | Ti + 1% Ni steel | 21 | 39 |

Table 2-continued

| Test No. | Sample piece material | amount of hydrogen absorbed in titanium (ppm) prior to test | after test |
|---|---|---|---|
| 5 | Ti + 5% Ni steel | 21 | 22 |
| 6 | Ti + 10% Ni steel | 21 | 22 |
| 7 | Ti + 30% Ni steel | 21 | 22 |
| 8 | Ti + 90% Ni steel | 21 | 22 |
| 9 | Ti + 25% Ni — 10% Al steel | 21 | 22 |
| 10 | Ti + 20% Ni — 10% S — 10% Al steel | 21 | 22 |
| 11 | Ti + 20% Ni — 10% Mn — 5% mo steel | 21 | 22 |
| 12 | Ti + 20% Ni — 2% Cr steel | 21 | 22 |
| 13 | Ti — 20% Ni — 10% Cr steel | 21 | 22 |
| 14 | Ti + 0.1% Cr steel | 21 | 102 |
| 15 | Ti + 0.5% Cr steel | 21 | 39 |
| 16 | Ti + 1% Cr steel | 21 | 23 |
| 17 | Ti + 10% Cr steel | 21 | 22 |
| 18 | Ti + 30% Cr steel | 21 | 22 |
| 19 | Ti + 3% Cr — 2% Ni steel | 21 | 23 |
| 20 | Ti + 3% Cr — 10% Si — 5% Mo steel | 21 | 22 |
| 21 | Ti + 5% Cr — 10% Si — Si — 10% Al — 5% Mo steel | 21 | 22 |
| 22 | Ti + 15 Cr — 10 Ni | 21 | 22 |

As is clear from the results of Table 2, the titanium sheet alone (Test No. 1) does not form a galvanic couple so that no hydrogen absorption by titanium occured. In contrast thereto, when steel was present as a galvanic couple forming material (Test No. 2), the amount of hydrogen absorbed by titanium sharply increased.

However, when the Fe-Ni based alloy containing not less than 1% by weight of Ni, and the Fe-Cr based alloy containing not less than 0.5% by weight of Cr are brought into contact with the titanium sheet (Test Nos. 4 to 13, and 15 to 22), no hydrogen absorption took place in the titanium sheet. It is therefore evident that when titanium-heat-transfer tubes are used in combination with clad sheets consisting of titanium or copper alloy and steel, steel tube plates, and steel buffle plates, then the heat transfer tubes are rapidly embrittled. However, when the tube plates (including clad sheets), buffle plates and shell are made of a Fe-Ni based alloy containing not less than 1%, preferably not less than 2% by weight of Ni, or a Fe-Cr based alloy containing not less than 0.5% by weight, preferably not less than 1% by weight of Cr, then hydrogen absorption in titanium-heat-transfer tubes may be minimized after minimized, thereby allowing the extension of the service life of the hot-sea-water-treating apparatus in a satisfactory manner.

As is apparent from the foregoing, according to the present invention, galvanic corrosion in copper alloy parts may be prevented by a simple means, and furthermore the hydrogen absorption in titanium or titanium alloy parts may be minimized to a satisfactory extent, thus leading to a desired extension of the service life of a hot-deaerated-sea-water-treating apparatus.

What is claimed is:

1. In an apparatus for treating hot sea water which contains components made of copper alloy and titanium or titanium alloys, the improvement comprising: a sacrificial anode provided in said apparatus in a position which contacts sea water, in a manner which establishes an electrical shortcircuit with said copper alloy and titanium or titanium alloy components serving as cathodes, said anode maintaining the potential of said components in the range of −0.5 to −0.65 V with respect to the potential at a saturated calomel electrode.

2. The apparatus of claim 1, wherein said copper alloy components are baffle plates, while said titanium or titanium alloy components are heat transfer tubes.

3. In an apparatus for treating hot sea water which contains titanium or titanium alloy components, the improvement comprising: the preparation of at least one component of said apparatus of a Fe-Ni based alloy containing not less than 1% by weight of Ni, or a Fe-Cr alloy containing not less than 0.5% by weight of Cr provided in said apparatus in a position which establishes an electrical shortcircuit with said components.

4. The apparatus of claim 3, wherein said components which establish an electrical shortcircuit with said titanium or titanium alloy components are made of a Fe-Ni based alloy containing not less than 2% by weight of Ni, or a Fe-Cr based alloy containing not less than 1% by weight of Cr.

5. An apparatus for treating hot sea water, comprising:

at least two heat transfer tubes made of a titanium or titanium alloy;

baffle plates for supporting the opposite ends of each of said heat transfer tubes;

supporting plates for supporting said heat transfer tubes and;

a shell encompassing said heat transfer tubes; the steam-exposed sides of said baffle plates, said supporting plates, and said shell being made of a Fe-Ni based alloy containing not less than 1% by weight of Ni, or a Fe-Cr based alloy containing not less than 0.5% by weight of Cr.

* * * * *